US007100222B2

(12) United States Patent
Metz et al.

(10) Patent No.: US 7,100,222 B2
(45) Date of Patent: Sep. 5, 2006

(54) APPARATUS AND METHOD FOR MOUNTING HOSPITAL BED ACCESSORIES

(75) Inventors: Darrell L. Metz, Batesville, IN (US); Terry J. Stratman, Villa Hills, KY (US); David J. Ulrich, Sunman, IN (US); Francis C. Ganance, Cincinnati, OH (US)

(73) Assignee: Hill-Rom Services, Inc., Wilmington, DE (US)

( * ) Notice: Subject to any disclaimer, the term of this patent is extended or adjusted under 35 U.S.C. 154(b) by 49 days.

(21) Appl. No.: 10/884,676

(22) Filed: Jul. 2, 2004

(65) Prior Publication Data

US 2005/0050635 A1 Mar. 10, 2005

Related U.S. Application Data

(63) Continuation-in-part of application No. 10/225,780, filed on Aug. 22, 2002, now Pat. No. 7,028,352.

(60) Provisional application No. 60/397,342, filed on Jul. 19, 2002, provisional application No. 60/314,276, filed on Aug. 22, 2001, provisional application No. 60/484,273, filed on Jul. 2, 2003.

(51) Int. Cl.
*A61G 7/05* (2006.01)

(52) U.S. Cl. ..... 5/430; 5/428; 5/503.1; 5/658

(58) Field of Classification Search ..... 5/503.1, 5/507.1, 658, 425, 428–430, 662
See application file for complete search history.

(56) References Cited

U.S. PATENT DOCUMENTS

| | | | |
|---|---|---|---|
| 421,656 | A | 2/1890 | Blanken |
| 993,119 | A | 5/1911 | Stannard |
| 1,398,203 | A | 11/1921 | Schmidt |
| 2,136,088 | A | 11/1938 | Steven |
| 2,164,484 | A | 7/1939 | Wolfe |
| 2,281,209 | A | 4/1942 | Smith |
| 2,452,366 | A | 10/1948 | Freund |
| 2,556,591 | A | 6/1951 | Loxley |
| 2,564,083 | A | 8/1951 | Stechert |
| 2,587,291 | A | 2/1952 | Rochers |
| 2,605,151 | A | 7/1952 | Shampaine |
| 2,644,173 | A | 7/1953 | James |
| 2,710,976 | A | 6/1955 | Martensen |
| 2,722,017 | A | 11/1955 | Burst et al. |
| 2,766,463 | A | 10/1956 | Bendersky |
| 2,817,854 | A | 12/1957 | Pratt |
| 2,817,855 | A | 12/1957 | Pratt |
| 2,869,614 | A | 1/1959 | Wamsley |

(Continued)

FOREIGN PATENT DOCUMENTS

DE 199 00 602 C 1 7/2000

(Continued)

OTHER PUBLICATIONS

Paramount Bed Product Brochure; date unknown.

(Continued)

*Primary Examiner*—Michael Trettel
(74) *Attorney, Agent, or Firm*—Bose McKinney & Evans LLP

(57) ABSTRACT

A patient support is provided. The patient support includes a frame, a mattress supported by the frame, and a set of siderails configured to block egress of a patient from the patient support. The siderails through use of adapters are configured to reduce gaps defined between the siderails and the other components of the patient support. The adapters may also be used to couple other medical accessories to the patient support.

31 Claims, 10 Drawing Sheets

U.S. PATENT DOCUMENTS

| | | | | |
|---|---|---|---|---|
| 2,951,252 | A | | 9/1960 | Roche |
| 3,010,121 | A | | 11/1961 | Breach |
| 3,018,492 | A | | 1/1962 | Rosen |
| 3,021,534 | A | | 2/1962 | Hausted |
| 3,053,568 | A | | 9/1962 | Miller |
| 3,055,020 | A | | 9/1962 | Mann |
| 3,099,440 | A | | 7/1963 | Burzlaff |
| 3,112,500 | A | | 12/1963 | MacDonald |
| 3,138,805 | A | | 6/1964 | Piazza |
| 3,148,387 | A | | 9/1964 | Sarnie et al. |
| 3,210,779 | A | | 10/1965 | Herbold |
| 3,220,021 | A | | 11/1965 | Nelson |
| 3,220,022 | A | | 11/1965 | Nelson |
| 3,233,255 | A | | 2/1966 | Propst |
| 3,239,853 | A | | 3/1966 | MacDonald |
| 3,249,387 | A | | 5/1966 | Pivacek |
| 3,256,533 | A | | 6/1966 | Michelsen |
| 3,309,717 | A | | 3/1967 | Black |
| 3,321,779 | A | | 5/1967 | Kaufman et al. |
| 3,344,445 | A | | 10/1967 | Crawford |
| 3,351,962 | A | | 11/1967 | Dodrill et al. |
| 3,406,772 | A | | 10/1968 | Ahrent et al. |
| 3,456,269 | A | | 7/1969 | Goodman |
| 3,486,176 | A | | 12/1969 | Murcott |
| 3,585,659 | A | | 6/1971 | Burst et al. |
| 3,593,350 | A | | 7/1971 | Knight et al. |
| 3,619,824 | A | | 11/1971 | Doyle |
| 3,640,566 | A | | 2/1972 | Hodge |
| 3,742,530 | A | | 7/1973 | Clark |
| 3,845,511 | A | | 11/1974 | Benoit et al. |
| 3,851,345 | A | | 12/1974 | Benoit et al. |
| 3,865,434 | A | | 2/1975 | Sully |
| 3,877,090 | A | | 4/1975 | Schutz |
| 3,893,197 | A | | 7/1975 | Ricke |
| 3,897,973 | A | | 8/1975 | Long et al. |
| 3,905,591 | A | | 9/1975 | Schorr et al. |
| 3,916,461 | A | | 11/1975 | Kerstholt |
| 3,971,083 | A | * | 7/1976 | Peterson ..... 5/430 |
| 4,127,906 | A | | 12/1978 | Zur |
| 4,139,917 | A | | 2/1979 | Fenwick |
| 4,168,099 | A | | 9/1979 | Jacobs et al. |
| 4,183,015 | A | | 1/1980 | Drew et al. |
| 4,186,456 | A | | 2/1980 | Huempfner |
| 4,214,326 | A | | 7/1980 | Spann |
| 4,215,446 | A | | 8/1980 | Mahoney |
| 4,232,415 | A | | 11/1980 | Webber |
| 4,240,169 | A | | 12/1980 | Roos |
| 4,258,445 | A | | 3/1981 | Zur |
| 4,312,500 | A | | 1/1982 | Janssen |
| 4,336,621 | A | | 6/1982 | Schwartz et al. |
| 4,370,765 | A | | 2/1983 | Webber |
| 4,409,695 | A | | 10/1983 | Johnston et al. |
| 4,439,880 | A | | 4/1984 | Koncelik et al. |
| 4,453,732 | A | | 6/1984 | Assanah et al. |
| D276,112 | S | | 10/1984 | Ferrell et al. |
| 4,557,471 | A | | 12/1985 | Pazzini |
| 4,607,402 | A | | 8/1986 | Pollard |
| 4,612,679 | A | | 9/1986 | Mitchell |
| 4,653,129 | A | | 3/1987 | Kuck et al. |
| 4,654,903 | A | | 4/1987 | Chubb et al. |
| 4,670,923 | A | | 6/1987 | Gabriel et al. |
| 4,672,698 | A | | 6/1987 | Sands |
| 4,675,926 | A | | 6/1987 | Lindblom et al. |
| 4,676,687 | A | | 6/1987 | Koffler |
| 4,685,159 | A | | 8/1987 | Oetiker |
| 4,704,750 | A | | 11/1987 | Wheelock |
| 4,710,049 | A | | 12/1987 | Chang |
| 4,710,992 | A | | 12/1987 | Falwell |
| 4,745,647 | A | | 5/1988 | Goodwin |
| 4,747,171 | A | | 5/1988 | Einsele et al. |
| 4,751,754 | A | | 6/1988 | Bailey et al. |
| 4,767,419 | A | | 8/1988 | Fattore |
| 4,768,249 | A | | 9/1988 | Goodwin |
| 4,783,864 | A | | 11/1988 | Turner |
| 4,800,600 | A | | 1/1989 | Baum |
| 4,827,545 | A | | 5/1989 | Arp |
| 4,839,933 | A | | 6/1989 | Plewright et al. |
| 4,847,929 | A | | 7/1989 | Pupovic |
| 4,858,260 | A | | 8/1989 | Failor et al. |
| 4,862,529 | A | | 9/1989 | Peck |
| 4,862,530 | A | | 9/1989 | Chen |
| 4,872,228 | A | | 10/1989 | Bishop |
| 4,873,734 | A | | 10/1989 | Pollard |
| 4,894,876 | A | | 1/1990 | Fenwick |
| 4,944,055 | A | | 7/1990 | Shainfeld |
| 4,974,905 | A | | 12/1990 | Davis |
| 4,985,946 | A | | 1/1991 | Foster et al. |
| 4,993,089 | A | | 2/1991 | Solomon et al. |
| 5,010,611 | A | | 4/1991 | Mallett |
| 5,035,014 | A | | 7/1991 | Blanchard |
| 5,040,253 | A | | 8/1991 | Cheng |
| 5,044,025 | A | | 9/1991 | Hunsinger et al. |
| 5,060,327 | A | | 10/1991 | Celestina et al. |
| 5,072,463 | A | | 12/1991 | Willis |
| 5,077,843 | A | | 1/1992 | Foster et al. |
| 5,083,332 | A | | 1/1992 | Foster et al. |
| 5,083,334 | A | | 1/1992 | Huck et al. |
| 5,084,925 | A | | 2/1992 | Cook |
| 5,097,550 | A | | 3/1992 | Marra |
| 5,129,117 | A | | 7/1992 | Celestina et al. |
| 5,175,897 | A | | 1/1993 | Marra |
| 5,179,744 | A | | 1/1993 | Foster et al. |
| 5,187,824 | A | * | 2/1993 | Stryker ..... 5/430 |
| 5,191,663 | A | | 3/1993 | Holder et al. |
| 5,193,633 | A | | 3/1993 | Ezenwa |
| 5,197,156 | A | | 3/1993 | Stryker et al. |
| 5,205,004 | A | | 4/1993 | Hayes et al. |
| D336,577 | S | | 6/1993 | Celestina et al. |
| 5,216,768 | A | | 6/1993 | Bodine et al. |
| 5,230,113 | A | | 7/1993 | Foster et al. |
| 5,279,010 | A | | 1/1994 | Ferrand et al. |
| 5,381,571 | A | | 1/1995 | Gabhart |
| 5,384,927 | A | | 1/1995 | Mardero et al. |
| 5,410,765 | A | | 5/1995 | Youngblood |
| 5,418,988 | A | | 5/1995 | Iura |
| 5,421,046 | A | | 6/1995 | Vande Streek |
| 5,450,641 | A | | 9/1995 | Montgomery |
| 5,454,126 | A | | 10/1995 | Foster et al. |
| 5,455,973 | A | | 10/1995 | Brumfield et al. |
| 5,479,666 | A | | 1/1996 | Foster et al. |
| 5,481,772 | A | | 1/1996 | Glynn et al. |
| 5,485,699 | A | | 1/1996 | Gabhart |
| 5,524,306 | A | | 6/1996 | Georeg |
| 5,537,701 | A | | 7/1996 | Elliot |
| 5,542,135 | A | | 8/1996 | Ozrovitz et al. |
| 5,557,817 | A | | 9/1996 | Haddock |
| 5,575,025 | A | | 11/1996 | Peters |
| 5,577,277 | A | | 11/1996 | Sundberg et al. |
| 5,577,279 | A | | 11/1996 | Foster et al. |
| 5,642,545 | A | | 7/1997 | Howard |
| 5,671,490 | A | | 9/1997 | Wu |
| 5,678,267 | A | * | 10/1997 | Kinder ..... 5/662 |
| 5,689,839 | A | | 11/1997 | Laganiere et al. |
| 5,715,548 | A | | 2/1998 | Weismiller et al. |
| 5,732,423 | A | | 3/1998 | Weismiller et al. |
| 5,745,937 | A | | 5/1998 | Weismiller et al. |
| 5,749,112 | A | | 5/1998 | Metzler |
| 5,761,756 | A | | 6/1998 | Nowak et al. |
| 5,771,506 | A | | 6/1998 | Joiner |
| 5,781,945 | A | | 7/1998 | Scherer et al. |
| 5,802,636 | A | | 9/1998 | Corbin et al. |
| 5,832,549 | A | | 11/1998 | Le Pallec et al. |
| 5,864,900 | A | | 2/1999 | Landau |
| 5,878,452 | A | | 3/1999 | Brooke et al. |

| | | | | |
|---|---|---|---|---|
| 5,926,873 | A | 7/1999 | Fountain | |
| 5,987,666 | A | 11/1999 | Zigmont | |
| 6,038,721 | A | 3/2000 | Gordon | |
| 6,058,531 | A | 5/2000 | Carroll | |
| 6,089,593 | A | 7/2000 | Hanson et al. | |
| 6,240,583 | B1 * | 6/2001 | Brooke et al. | 5/662 |
| 6,320,510 | B1 | 11/2001 | Mendedick et al. | |
| 6,321,878 | B1 | 11/2001 | Mobley et al. | |
| 6,347,422 | B1 | 2/2002 | Heavrin | |
| 6,397,416 | B1 | 6/2002 | Brooke et al. | |
| 6,401,277 | B1 | 6/2002 | Savage et al. | |
| 6,401,281 | B1 | 6/2002 | Younge | |
| 6,427,264 | B1 | 8/2002 | Metz et al. | |
| 6,430,766 | B1 | 8/2002 | Henley et al. | |

FOREIGN PATENT DOCUMENTS

| | | |
|---|---|---|
| EP | 0 037 063 A2 | 10/1981 |
| FR | 1450817 | 8/1966 |
| GB | 1466080 | 3/1977 |
| GB | 2 313 303 A | 11/1997 |
| WO | WO 98/17153 | 4/1998 |
| WO | WO 99/15126 | 4/1999 |

OTHER PUBLICATIONS

Hill-Rom Med Surg Bed Accessories; date:1997.

* cited by examiner

APPARATUS AND METHOD FOR MOUNTING HOSPITAL BED ACCESSORIES

This application is a continuation-in-part of U.S. patent application Ser. No. 10/225,780, filed on Aug. 22, 2002, now U.S. Pat. No. 7,028,352, which claims the benefit of U.S. Provisional Patent Application Ser. No. 60/397,342, filed on Jul. 19, 2002, and U.S. Provisional Patent Application Ser. No. 60/314,276, filed on Aug. 22, 2001, and further claims the benefit of U.S. Provisional Patent Application Ser. No. 60/484,273, filed on Jul. 2, 2003, the disclosures of which are expressly incorporated by reference herein.

BACKGROUND AND SUMMARY OF THE INVENTION

The present invention relates to patient supports, such as hospital beds. More specifically, the present invention relates to the apparatus and methods for closing gaps that may exist between components on a patient support. The present invention further relates to apparatus and methods for mounting accessories, such as siderails, to a hospital bed.

In an illustrative embodiment of the present invention, a patient support includes a frame having a longitudinally extending first side frame member and a longitudinally extending second side frame member positioned in laterally spaced relation to the first side frame member. An articulating deck is supported by the frame and a longitudinally extending support member is coupled to the first frame member. An accessory mount is coupled to the support member and is configured to selectively move longitudinally along the support member. A medical accessory is coupled to the accessory mount.

According to a further illustrative embodiment of the present invention, a patient support includes a deck, a mattress supported by the deck, and a first siderail positioned adjacent the deck and configured to extend above the mattress. A second siderail is positioned adjacent the first siderail and defines a longitudinally extending gap between the second siderail and the first siderail. The second siderail includes a rail member, a linkage base, and a linkage coupling the rail member to the linkage base for movement of the rail member relative to the mattress between a raised position and a lowered position. The linkage base of the second siderail is supported for longitudinal movement relative to the first siderail for adjusting the longitudinal dimension of the gap.

According to yet another illustrative embodiment of the present invention, a siderail assembly for a patient support includes a rail member, a support rail configured to couple to a frame of the patient support, and a mount coupled to the support rail and configured to selectively move along the support rail. The accessory mount includes a lock configured to prevent movement of the mount along the support rail. A linkage is coupled between the rail member and the mount and supports the rail member for movement between a raised position and a lowered position.

In a further illustrative embodiment of the present invention, a method is provided for altering a patient support including a deck support, an articulating deck, a first siderail coupled to the articulating deck, and a second siderail positioned in spaced relation to the first siderail. The method comprises the steps of uncoupling the first siderail from the articulating deck, and coupling the first siderail to the deck support.

According to yet another illustrative embodiment of the present invention, a sub-frame is provided for supporting at least one siderail of a patient support, the patient support including at least one siderail, an articulating deck and a deck support having at least one post. The sub-frame comprises a body member, a first mount adapted to couple to the deck support, and a second mount adapted to couple to the deck. The body member extends between the first mount and the second mount. A rail mount is coupled to the body member and is adapted to support at least one siderail of the patient support.

Additional features and advantages of the present invention will become apparent to those skilled in the art upon consideration of the following detailed description of the presently perceived best mode of carrying out the invention.

BRIEF DESCRIPTION OF THE DRAWINGS

The detailed description of the drawings particularly refers to the accompanying figures in which.

DETAILED DESCRIPTION OF THE DRAWINGS

Figure 1:
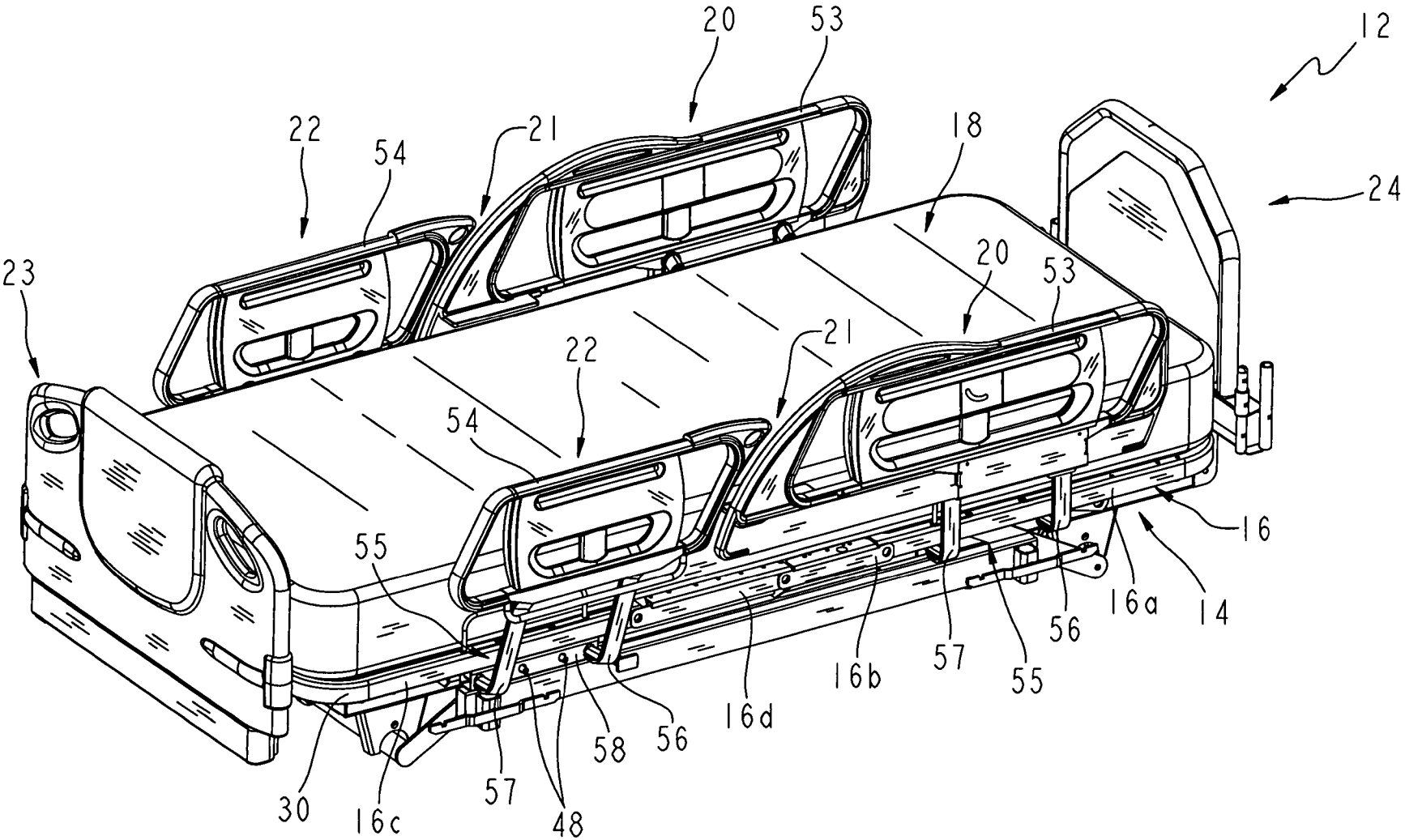
FIG. 1 is a perspective view of the intermediate and upper portions of a patient support showing the patient support including an intermediate frame, a deck supported by the intermediate frame, a mattress positioned on the deck, a footboard, a headboard, a pair of head end siderails, and a pair of foot end siderails.
Figure 2:
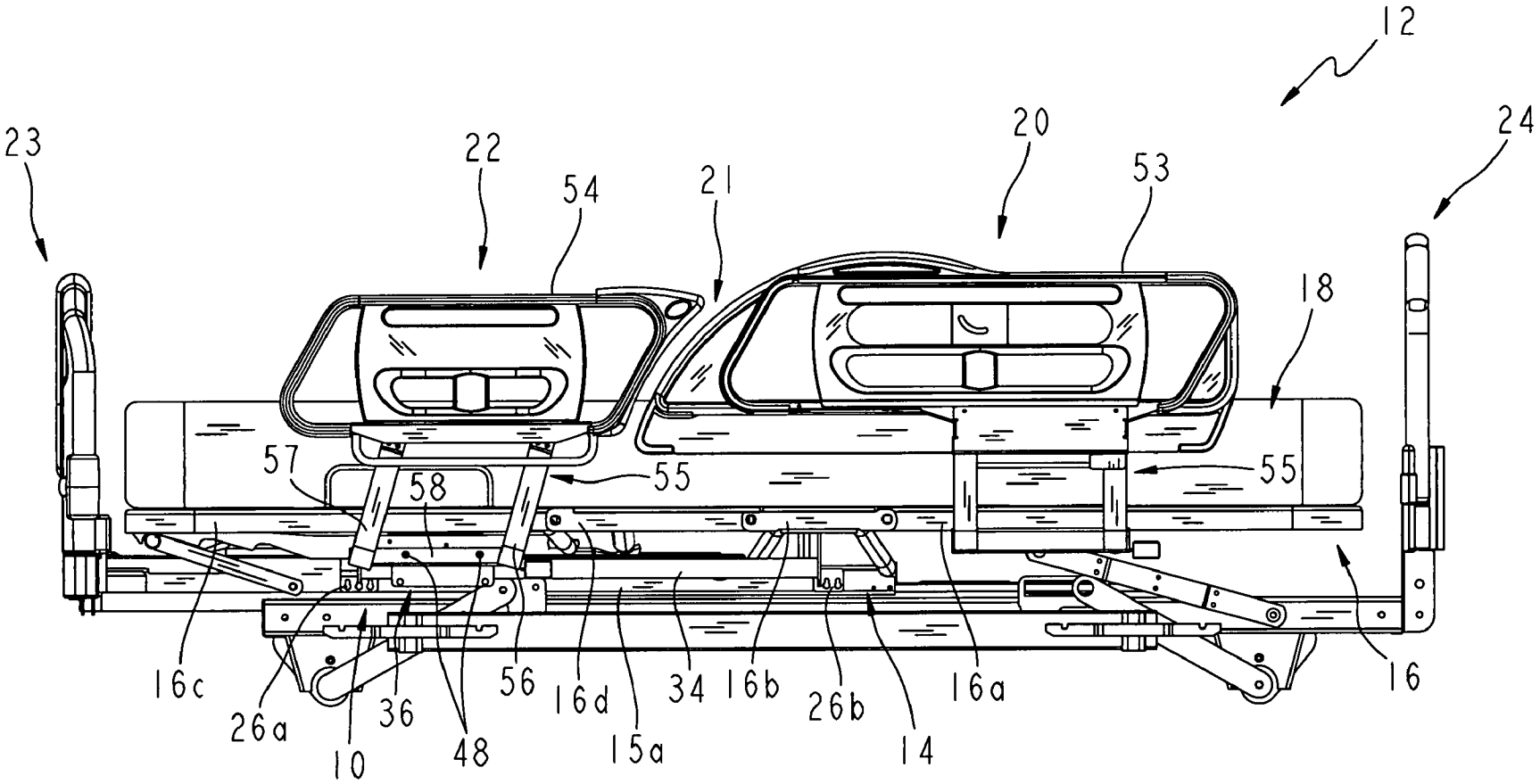
FIG. 2 is a side elevational view of the patient support of FIG. 1.
Figure 3:
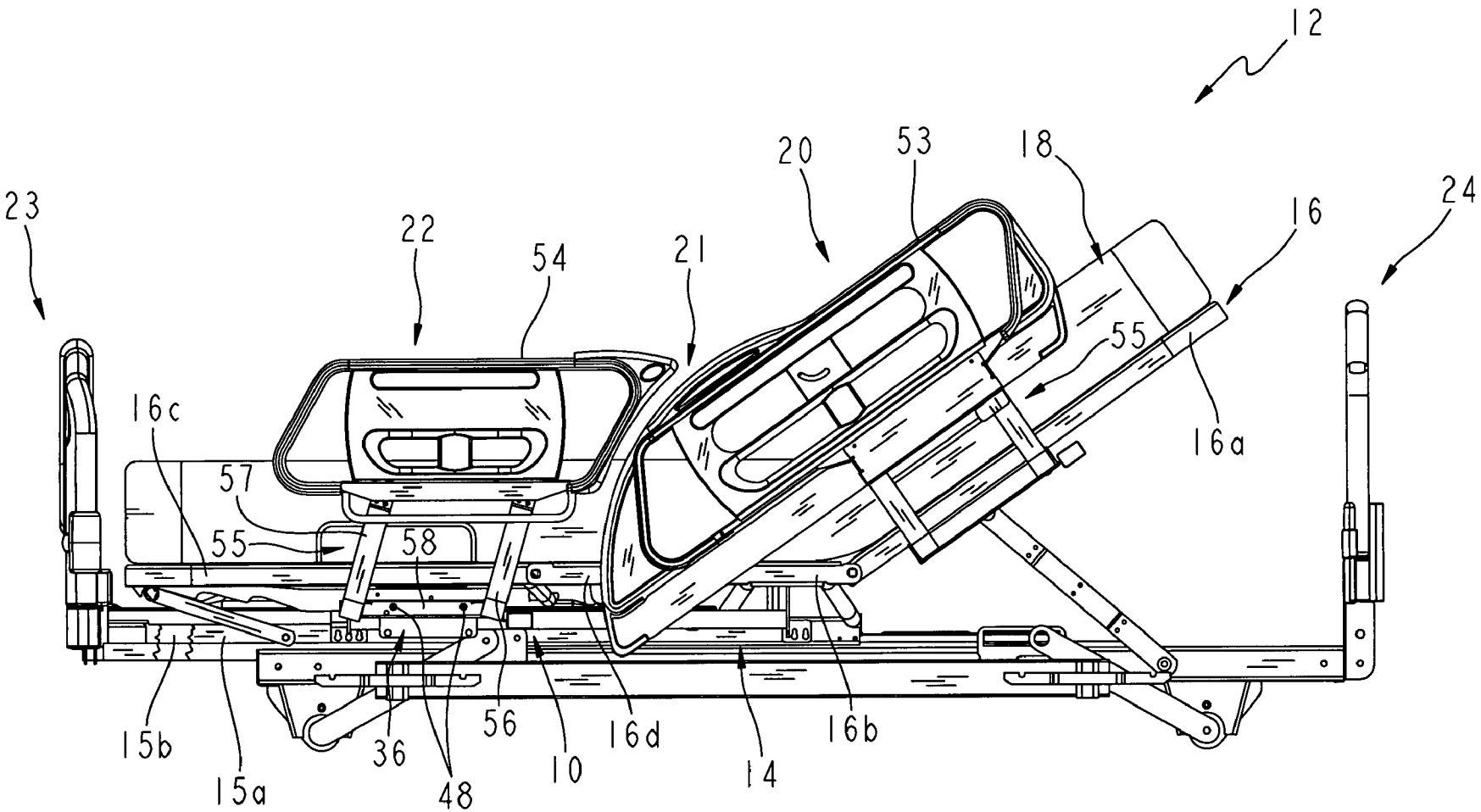
FIG. 3 is a side elevational view similar to FIG. 2, showing a head section of the deck tilted and with a partial cutaway showing the second side frame member.

The present invention relates to siderail mounting adapters or sub-frames 10, 60, 110, 160 configured for use on a patient support 12 which may be similar to the bed illustrated in FIGS. 1–3. The illustrative patient support 12 of FIG. 1 includes an intermediate frame or deck support 14, an articulating deck 16, a mattress 18 supported by deck 16, head end and foot end siderails 20, 22, a footboard 23 and a headboard 24. The frame 14 includes longitudinally extending, laterally spaced first and second side frame members 15*a* and 15*b*. The deck 16 is of conventional design and includes a head section 16*a* pivotally coupled to a seat section 16*b*. Likewise, a foot section 16*c* is supported for pivoting movement relative to the seat section 16*b*. In the illustrative embodiment, a thigh section 16*d* is pivotally coupled intermediate the seat section 16*b* and the foot section 16*c*. Further illustratively, the seat section 16*b* is rigidly mounted to the intermediate frame 14 to prevent movement therebetween. Head end siderails 20 are coupled to head section 16*a* of the deck 16, while adapter 10 allows foot end siderails 22 to be coupled to the intermediate frame 14. Additional details of patient support 12, including siderails 20, 22, are described in U.S. patent application Ser. No. 10/225,780, filed Aug. 22, 2002, which is assigned to the assignee of the present invention and is expressly incorporated by reference herein.

Patient support 12 may be produced originally in a manufacturing plant as an OEM bed or by retrofitting an existing patient support such as the patient support shown in U.S. Pat. Nos. 6,321,878 and 6,320,510, the disclosures of which are expressly incorporated by reference herein. When building an OEM bed, adapter 10 is coupled to frame 14 at the manufacturing plant. When retrofitted at the point of use or otherwise, adapter 10 is coupled to frame 14 at a location away from the manufacturing plant. During an OEM installation, foot end siderails 22 are initially mounted to adapter 10. During a non-OEM retrofit, foot end siderails 22 are removed from being coupled to the foot section 16*c* of the deck 16 and are then coupled to the adapter 10 so that the foot end siderails 22 no longer articulate with the foot section 16*c*. In either OEM or retrofit installations, adapter 10 permits selective longitudinal movement of the siderail 22. The movement ability allows for the adjustment of a longitudinally extending gap 21 between the foot end siderail 22 and the head end siderail 20.

Figure 4:
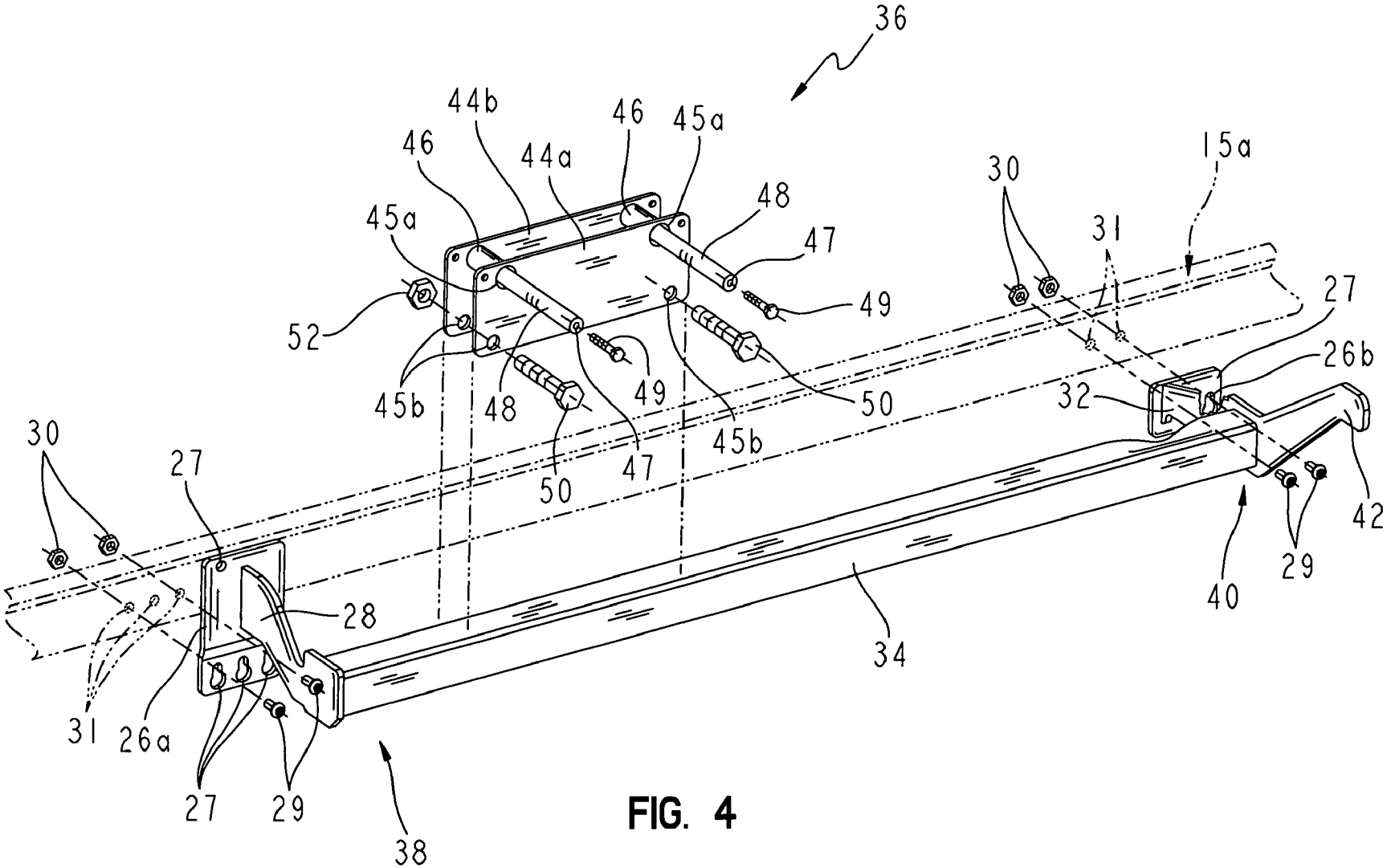
FIG. 4 is a partially exploded perspective view of an adapter configured to couple a foot end siderail to the intermediate frame of a patient support having a retracting foot section.

As shown in FIGS. 2–4, adapter 10 includes a first or foot end frame mount 26*a*, a second or head end frame mount 26*b*, a foot end extension arm 28, and a head end extension arm 32. A support member, illustratively a tubular rail 34 having a square cross-section, extends longitudinally between the foot end extension arm 28 and the head end extension arm 32 and in laterally spaced relation to side frame member 15*a*. An accessory or rail mount, illustratively a siderail bracket 36, is coupled to the support member 34 and is supported for selective sliding movement therealong. Frame mounts 26 are each illustratively a plate welded to a respective extension arm 28, 32. Frame mounts 26 illustratively include apertures 27 formed therein to allow bolts 29 or other fasteners to pass therethrough and cooperate with nuts 30 to couple frame mounts 26 to frame 14 of patient support 12. Illustratively, existing holes 31 in frame 14 are used with the fasteners 29. Furthermore, the apertures 27 in frame mounts 26 may be keyhole type apertures such that existing fasteners 29 do not need to be completely removed in order for frame mounts 26 to fasten thereto (FIG. 4). Foot end extension arm 28 extends from frame mount 26*a* outwardly and generally downwardly to a portion that couples to a foot end 38 of support member 34. Head end extension arm 32 extends from frame mount 26*b* outwardly and generally upwardly to a portion that couples to head end 40 of support member 34. Head end extension arm 32 then extends beyond support member 34 outwardly and upwardly to a deck abutment portion 42, as shown in FIG. 4.

Accessory mount 36 includes first and second laterally spaced mount plates 44*a* and 44*b*, two spacers, illustratively cylinders 46, and two siderail mounting posts or rods 48. Illustratively, each mount plate 44 is substantially rectangular in shape with a plurality of apertures 45 defined therein. A pair of upper apertures 45*a* are sized and shaped to support mounting posts 48. Spacer cylinders 46 are aligned with the upper two apertures 45*a*, and are illustratively welded to the mount plates 44, such that each mounting post 48 passes through an aperture 45*a* of first mount plate 44*a*, a bore of a spacer cylinder 46, and through an aperture 45*a* of the second mount plate 44*b*. Accessory mount 36 may be selectively longitudinally positioned as desired along support bar 34 and laterally positioned on mounting posts 48. Mounting posts 48 preferably have threaded bores 47 therein such that siderail 22 can be secured to mounting posts 48 via mounting screws or bolts 49 received in the threaded bores 47.

Clamp bolts 50 pass through a pair of lower apertures 45*b* and are secured by nuts 52. Clamp bolts 50 and their respective nuts 52 engage mount plates 44 so as to urge mount plates 44 closer to each other, thereby frictionally engaging, or clamping, support bar 34 positioned therebetween. The frictional engagement of mounting plates 44 to support bar 34 fixes the position of accessory mount 36 and thereby defines a set range of motion that foot end siderail 22 may travel within and defines a set relationship with respect to the rest of the parts of patient support 12, including adjacent head end siderail 20, as shown in FIGS. 1–3.

Figure 5:
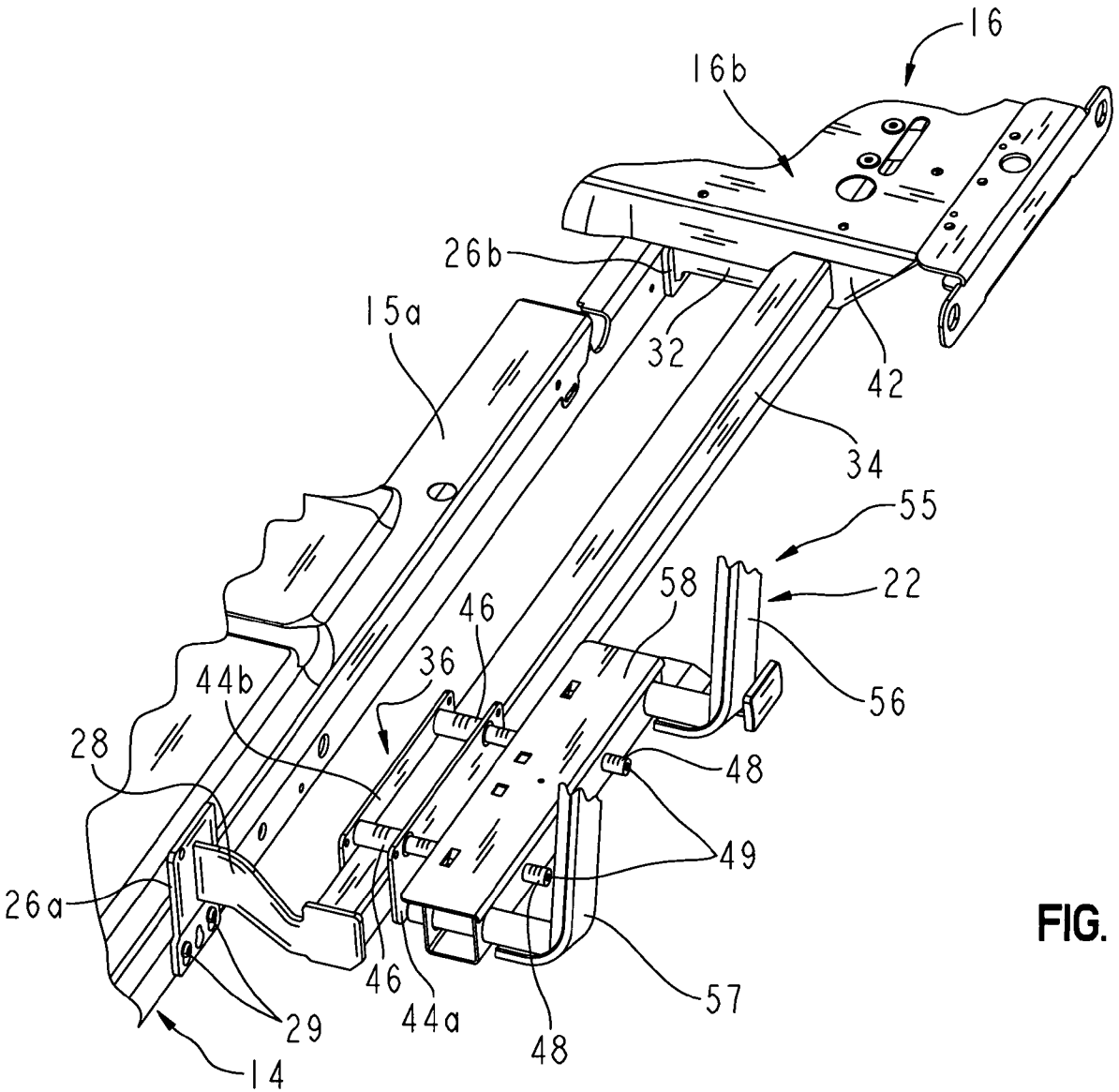
FIG. 5 is a perspective view of the adapter of FIG. 4 that is coupled to the foot end siderail and to the intermediate frame of the patient support, the head end of the adapter including a deck abutment portion configured to abut a bottom of a seat section of the deck.
Figure 6:
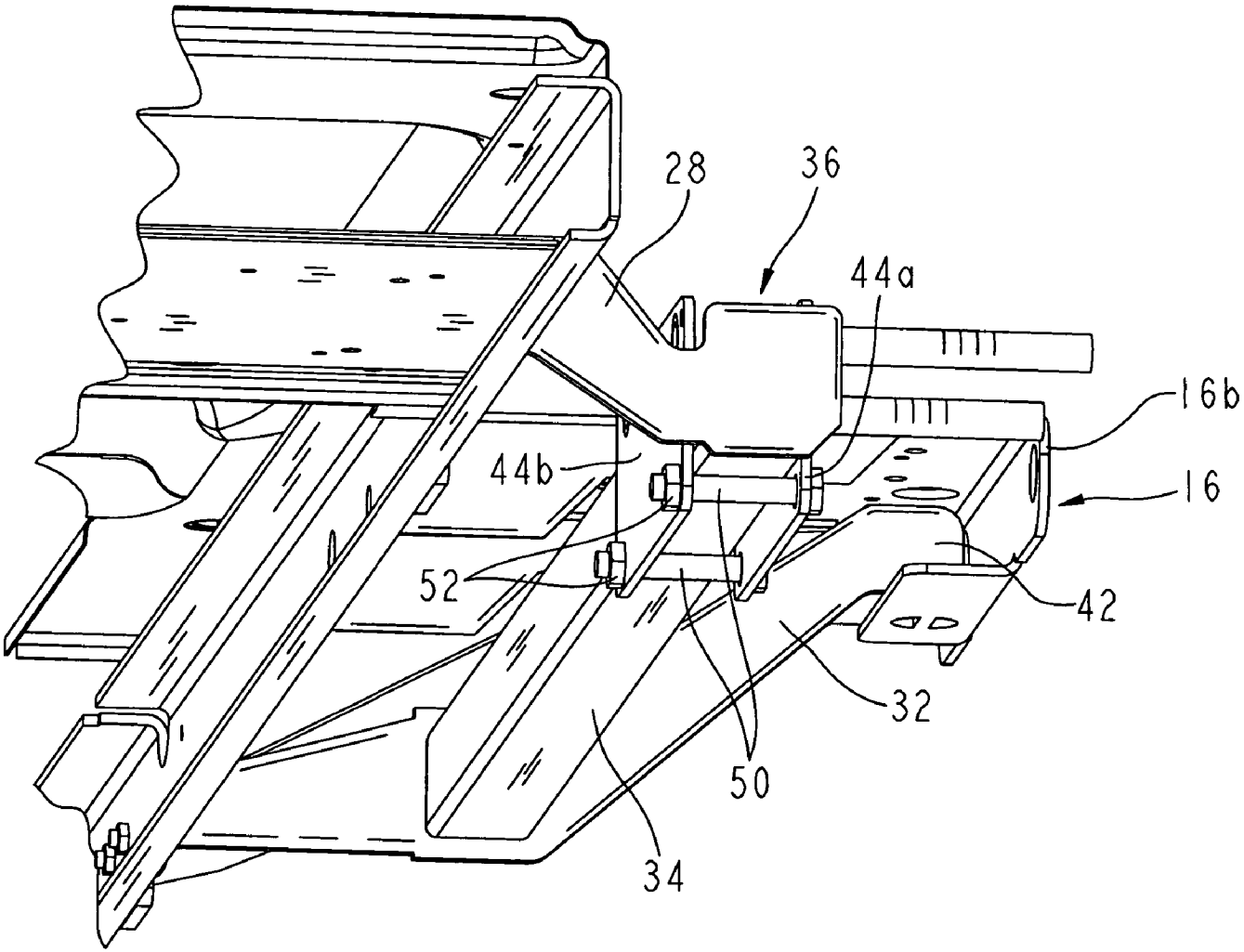
FIG. 6 is a detailed perspective view showing the deck abutment portion of the adapter of FIG. 5 engaging the bottom of the seat section.

Siderails 20 and 22 are illustratively of the kind described in U.S. patent application Ser. No. 10/225,780, the specification of which has been expressly incorporated by reference herein. Referring to FIGS. 2, 3, and 5, head end siderails 20 and foot end siderails 22 each include a rail member 53, 54 and a linkage 55 configured to move the rail member 53, 54 between a raised position and a lowered position. Linkage 55 includes first and second support arms 56, 57 pivotally coupling the rail member 53, 54 to a linkage base 58. Linkage bases 58 of the foot end siderails 22 are coupled to respective mounting posts 48 of accessory mount 36 to permit sliding on mounting posts 48 (FIG. 5). This permits lateral movement of the linkage bases 58 and the remainder of the foot end siderails 22 relative to the deck 16.

Foot end siderails 22 are coupled to the intermediate frame 14 through the adapter 10 rather than to the deck 16 of the patient support 12, as shown in FIGS. 1–3. Therefore, during articulation of the foot section 16*c* of the deck 16, the foot end siderails 22 remain stationary.

Figure 7:
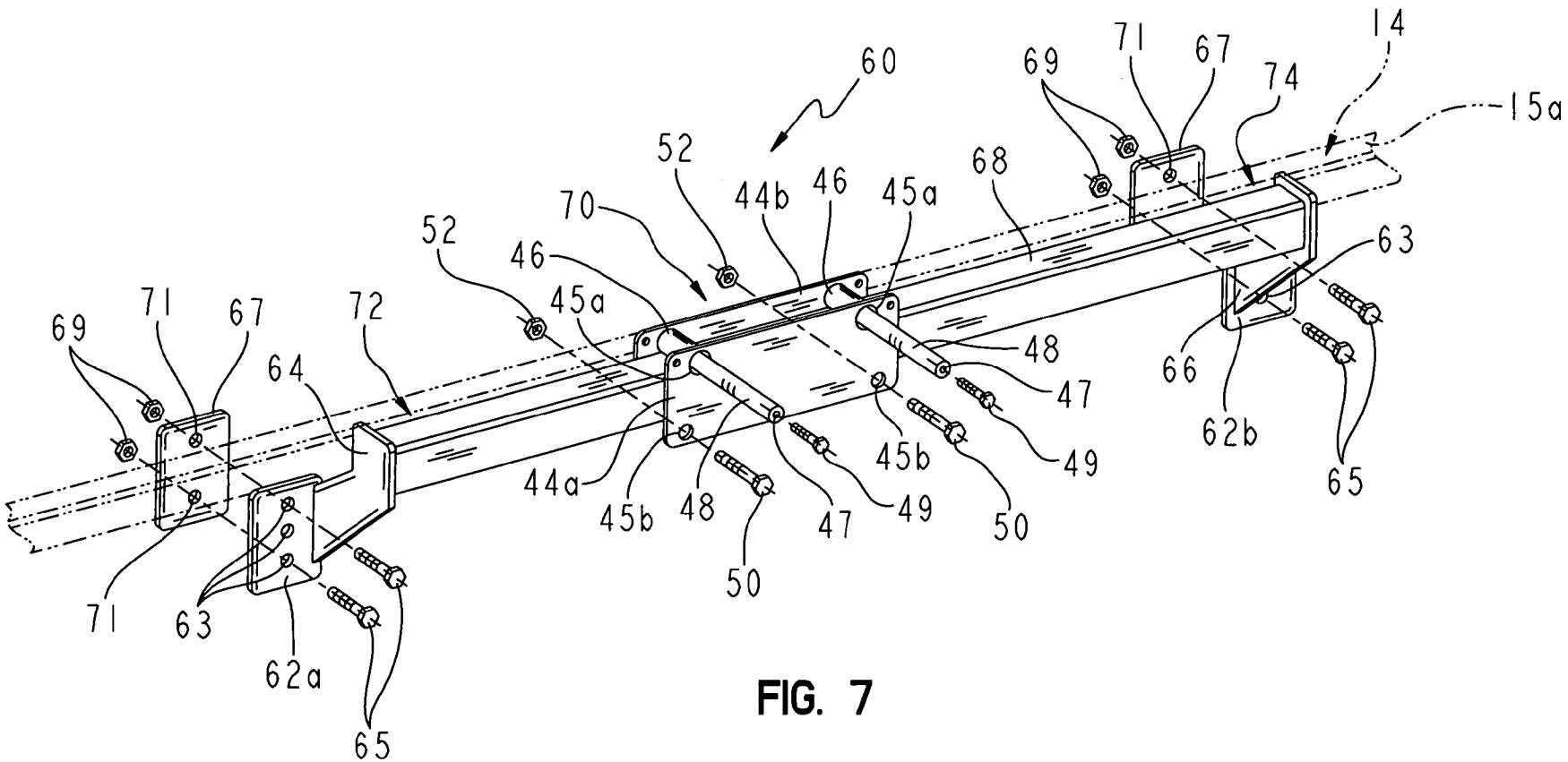
FIG. 7 is a perspective view of a further illustrative embodiment adapter for use with a patient support having a non-retracting foot section and including an accessory mount that is similar to that illustrated in FIG. 4.

A further illustrative embodiment sub-frame or adapter 60, shown in FIG. 7, is provided for use with a bed 12 having a non-retractable foot section 16*c*. It should be appreciated that differentiating between adapters 10, 60 for retractable and non-retractable foot sections 16*c* is done only due to the structural differences of the intermediate frame 14 which facilitates retraction of the foot section 16*c*. It should be further appreciated that other embodiments for other bed types are envisioned where the bed configurations so demand. Adapter 60 includes a first or foot end frame mount 62*a* and a second or head end frame mount 62*b* which perform functions similar to frame mounts 26*a* and 26*b*. Adapter 60 further includes a foot end extension arm 64, a head end extension arm 66, a support member 68, and an accessory mount 70. Frame mounts 62*a* and 62*b* are illustratively each perpendicularly welded to one of the extension arms 64 and 66. Frame mounts 62 also include apertures 63 formed therein to allow bolts 65 or other fasteners to pass therethrough to couple frame mounts 62 to frame 14 of patient support 12. In the illustrative embodiment, the bolts 65 pass above and below a portion of the side frame member 15*a* of intermediate frame 14 and continue through apertures 71 formed in clamp plates 67, thereby coupling the frame mounts 62 to clamp plates 67. Nuts 69 are threadably received on the bolts 65, which together pull the clamp plates 67 toward the frame mounts 62 and clamp the portion of the intermediate frame 14 therebetween.

Foot end extension arm 64 extends from frame mount 62*a* outwardly and generally upwardly to a portion that couples to a foot end 72 of support member 68. Head end extension arm 66 extends from frame mounts 62*b* outwardly and generally upwardly to a portion that couples to head end 74 of support member 68. Head end extension arm 66 is a mirror image of foot end extension arm 64. Accessory mount 70 is substantially identical in form and function to accessory mount 36 detailed above. Further, the foot end siderail 22 couples to the accessory mount 70 in an identical manner as to the accessory mount 36. As such, like reference numerals identify like components.

Figure 8:
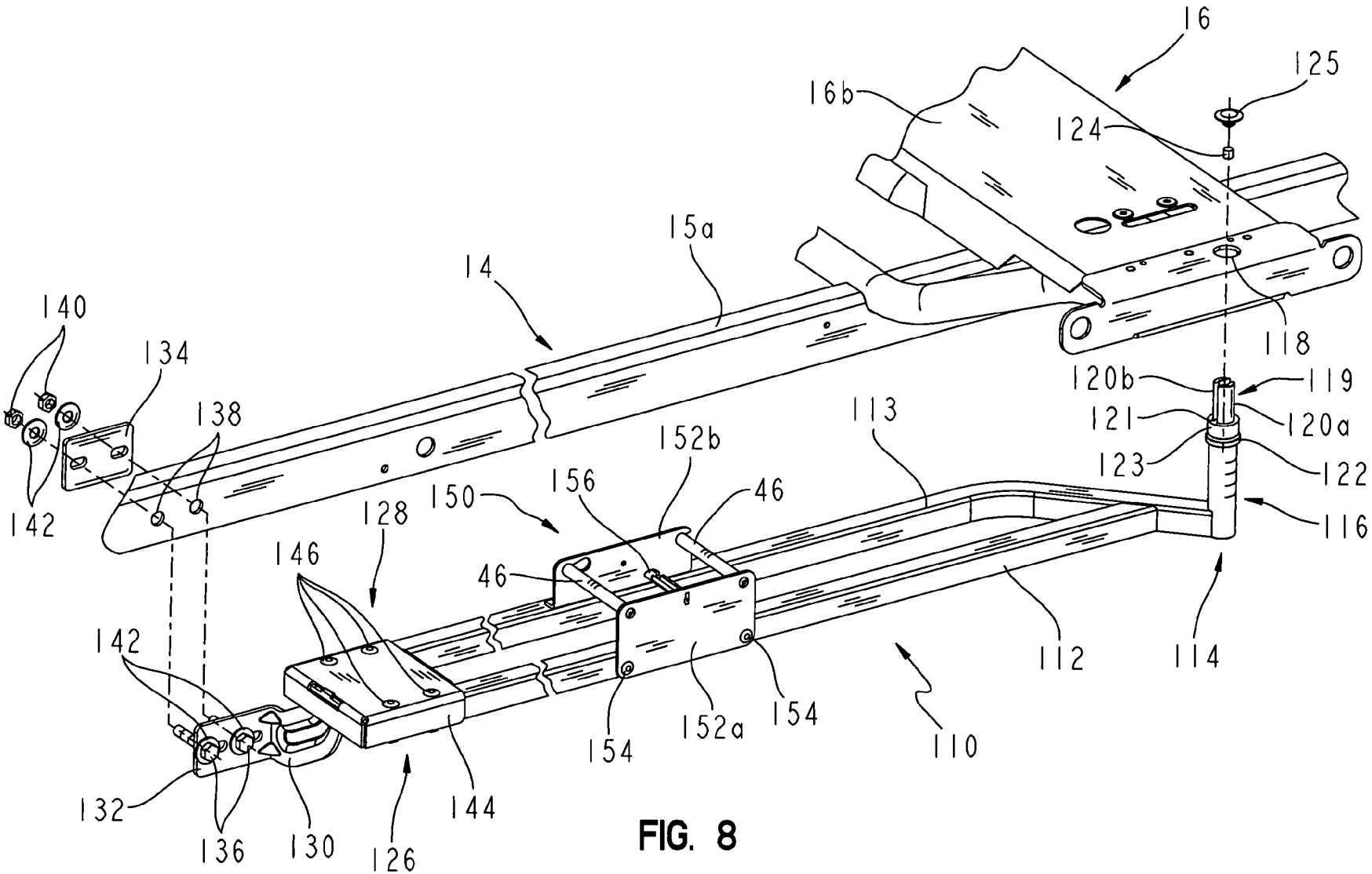
FIG. 8 is a perspective view of a further illustrative embodiment adapter configured to couple a foot end siderail to the seat section of the deck and to the intermediate frame of a patient support.
Figure 9:
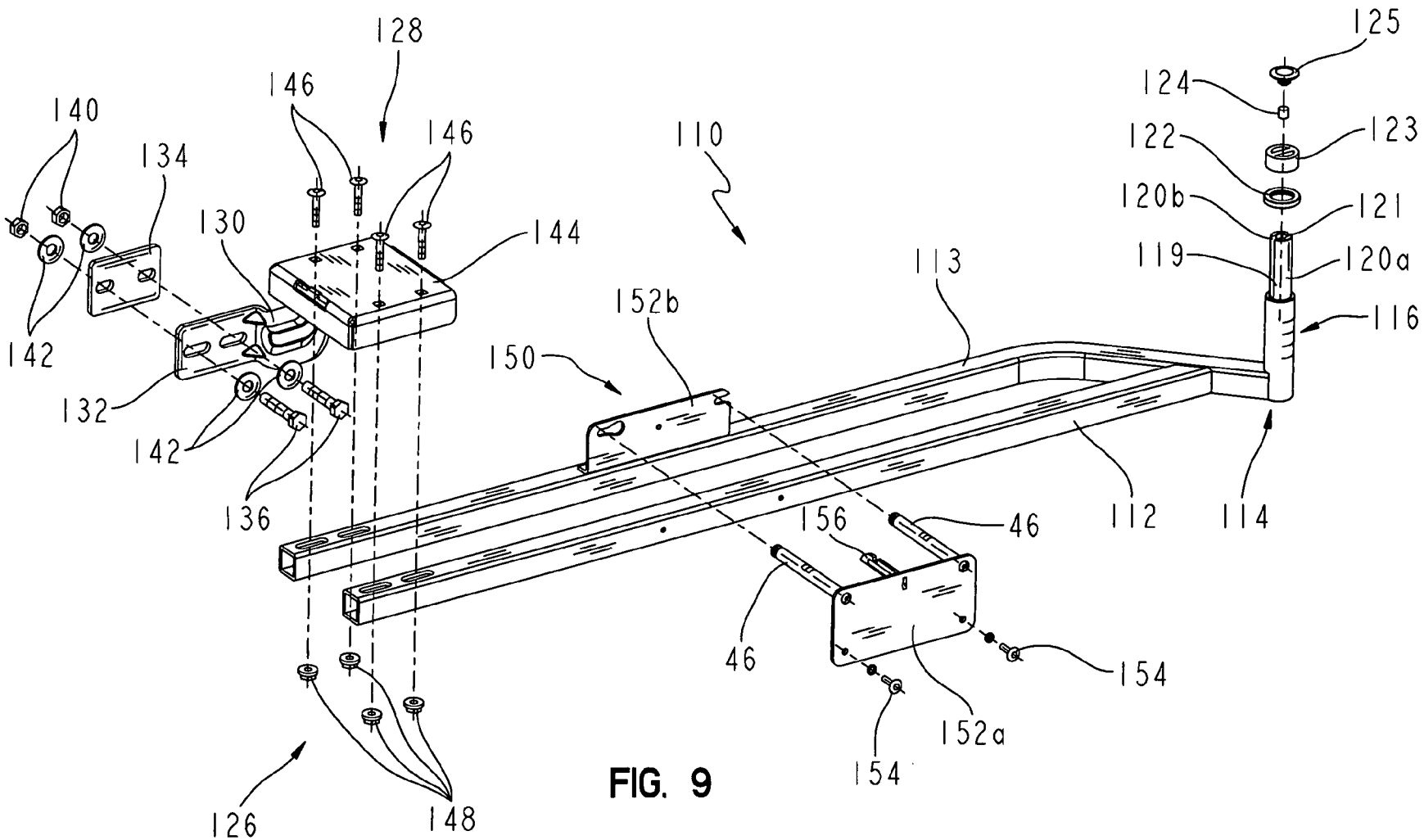
FIG. 9 is a detailed perspective view of the adapter of FIG. 7.

As shown in FIGS. 8 and 9, another illustrative embodiment sub-frame or adapter 110 is provided. Adapter 110 includes a pair of outer and inner rail members 112, 113. Rail members 112, 113 meet at a head end 114 and terminate in a first or deck mount 116 configured to be received within or below a hole 118, illustratively the OEM seat section I.V. socket aperture, in a seat section 16*b* of deck 16 as shown in FIG. 8. The deck mount 116 illustratively includes an upwardly extending post 119. In the illustrative embodiment, the post 119 is split into two portions 120*a* and 120*b* separated by a slot 121. A retaining ring 122 is concentrically received over the post 119, while a sleeve 123 receives the two portions 120*a* and 120*b*. A fastener, illustratively a screw 124, is threadably secured by the post 119 thereby securing the deck mount 116 to the seat section 16*b*. A plug or cap 125 is supported above the post 119.

While deck 16 is an articulating deck, seat section 16*b* does not move relative to frame 14. A foot end 126 of adapter 110 includes a second or frame mount 128 including an extension arm 130 and a mounting plate 132. Extension arm 130 extends between rail bars 112, 113 and downwardly to mounting plate 132. Mounting plate 132 functions similarly to frame mounts 26, 62 by attaching to frame 14 of patient support 12.

A clamp plate 134 is coupled to the mounting plate 132 through bolts 136. The bolts 136 pass through holes 138 formed in the side frame member 15*a* and threadably receive nuts 140, thereby securing the frame mount 128 to the intermediate frame 14. Conventional washers 142 may be used within the frame mount 128 as necessary.

The arm 130 couples the mounting plate 132 to a coupling block 144. The coupling block 144 is illustratively secured to the foot end 126 of rail members 112 and 113 by bolts 146 threadably receiving nuts 148. An accessory or rail mount 150 is coupled to rail members 112 and 113. Accessory mount 150 is similar to accessory mounts 36, 70, but includes mounting plates 152 rigidly fixed relative to rail bars 112 and 113. More particularly, second mounting plate 152*b* is illustratively welded to inner rail member 112, while first mounting plate 152*a* is illustratively secured to outer rail member 113 by screws 154. As such, the longitudinal position of the bracket 130 and the siderail 22 is not adjustable. A key 156 is positioned intermediate the spacers 46 and is configured to cooperate with the foot end siderail 22 by engaging a keyway (not shown) when the siderail 22 is in a raised position. Engagement of the key 156 in the keyway prevents the lateral movement of the siderail 22.

Figure 10:
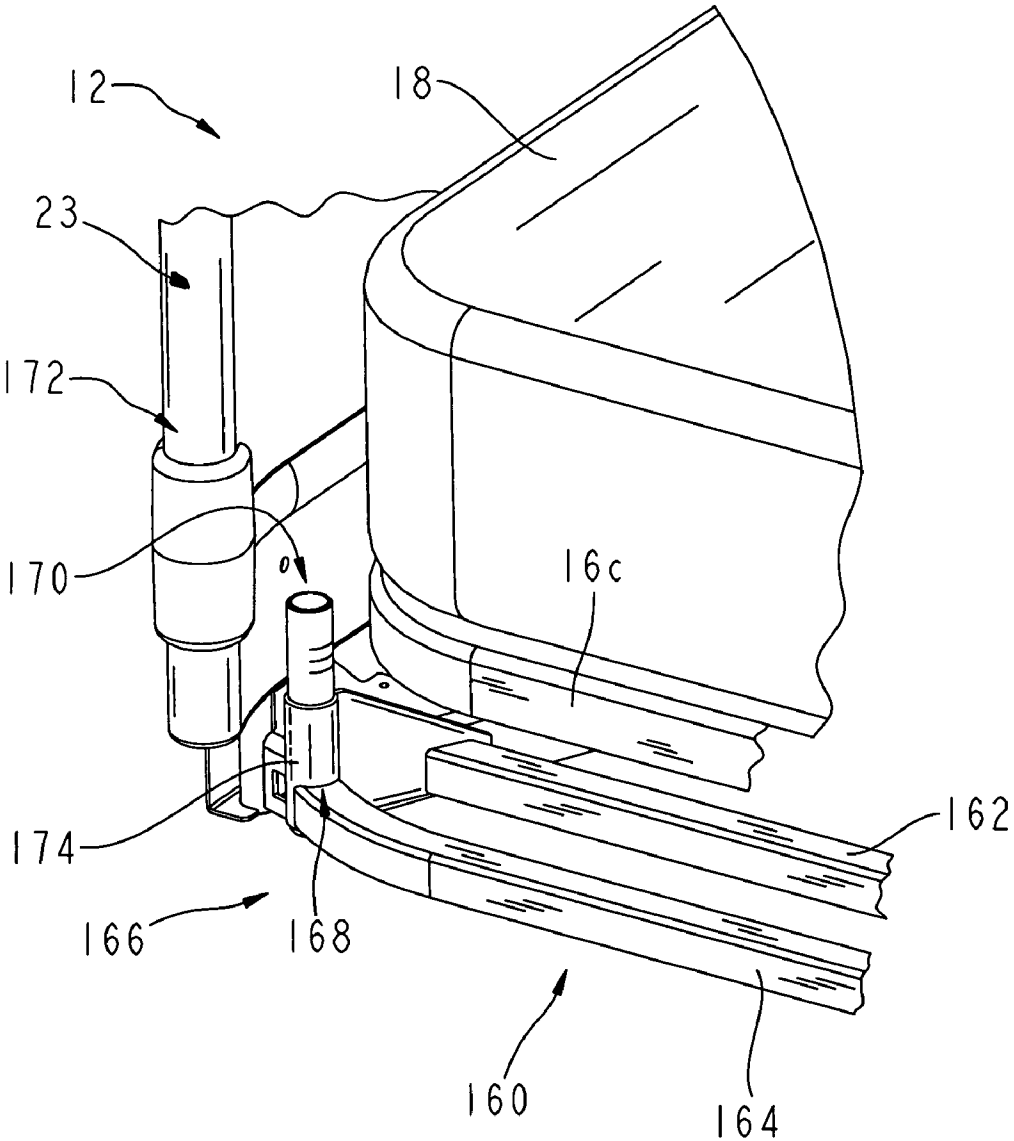
FIG. 10 is a detailed perspective view of the foot end of another illustrative embodiment adapter, similar to that shown in FIG. 9, coupled to a I.V. pole attachment portion of the intermediate frame of the bed.

As shown in FIG. 10, another embodiment adapter 160 is provided similar to adapter 110. Like adapter 110, adapter 160 includes outer and inner rail bars 162, 164. Head end (not pictured) of adapter 160 is similar to head end 114 of adapter 110 and includes a deck mount 116 configured to couple to seat section 16*b* of deck 16. Foot end 166 of adapter 160 includes a an I.V. socket 168. I.V. socket 168 is sized and shaped to slide over a cylindrical I.V. mount post 170 of frame 14 positioned near a foot end 172 of patient support 12. I.V. socket 168 includes a slide cylinder or cylindrical member 174.

Cylindrical member 174 defines a circular aperture therein. The circular aperture has an inner diameter slightly larger than an outer diameter of cylindrical I.V. mount post 170. Cylindrical member 174 passes over cylindrical I.V. mount post 170 so cylindrical I.V. mount post 170 is positioned within the circular aperture of cylindrical member 174. Cylindrical member 174 is slightly shorter than cylindrical I.V. mount post 170 such that cylindrical I.V. mount post 170 extends out of circular aperture when cylindrical I.V. mount post 170 is seated thereon.

Preferably, instructions for the assembly, installation, and/or use of the patient supports and other devices disclosed herein are provided with the patient supports of other devices or otherwise communicated to permit a person or machine to assemble, install and/or use the patient supports and other devices. Such instructions may include a description of any or all portions of patient supports and devices and/or any or all of the above-described assembly, installation, and use of the patient supports and devices. Furthermore, such instructions may describe the environment in which patient supports and devices are used. The instructions may be provided on separate papers and/or the packaging in which the patient support or other devices are sold or shipped. Furthermore, the instructions may be embodied as text, pictures, audio, video, or any other medium or method of communicating instructions known to those of ordinary skill in the art. Such instructions will instruct the user to perform a set of steps to assemble the adapter to the patient support. Such steps will preferably include some or all the steps selected from the set of: removing the siderail, attaching the adapter to the patient support, attaching the siderail to the adapter, adjusting the position of the siderail on the adapter, and fixing the position of the siderail on the adapter.

While the adapters 10, 60, 110, 160 have been described as adapters for mounting siderails, it should be appreciated that other bed accessories such as overbed tables, patient positioning devices, traction equipment, patient egress handles or devices, I.V. pole positioning devices, and the like may also be attached to adapters 10, 60, 110, 160. It should also be appreciated that the above described adapters 10, 60, 110, 160 allow spacing between adjacent rails, rails and a headboard, rails and a footboard, as well as rails and other bed accessories to be defined at desired sizes. Furthermore, if safety guidelines or regulations change, the adjustability of the adapters will allow further change without another retrofit.

Although the invention has been described in detail with reference to certain preferred embodiments, variations and modifications exist within the scope and spirit of the present invention.

The invention claimed is:

1. A patient support comprising:

a frame including a longitudinally extending first side frame member and a longitudinally extending second side frame member positioned in laterally spaced relation to the first side frame member;

an articulating deck supported by the frame;

a longitudinally extending support member detachably coupled to the first frame member;

an accessory mount coupled to the support member and configured to selectively move longitudinally along the support member; and a medical accessory coupled to the accessory mount.

2. The patient support of claim 1, wherein the medical accessory comprises a siderail.

3. The patient support of claim 2, wherein the siderail includes a rail member and a linkage coupled intermediate the rail member and the accessory mount.

4. The patient support of claim 3, wherein the linkage comprises a linkage base coupled to the accessory mount, and a support arm pivotally coupling the rail member to the linkage base.

5. The patient support of claim 1, wherein the accessory mount includes a pair of spaced-apart rods configured to permit lateral sliding movement of the siderail relative thereto.

6. The patient support of claim 1, further comprising:

a first frame mount configured to couple a first end of the support member to the first frame member; and a second frame mount configured to couple a second end of the support member to the first frame member.

7. The patient support of claim 6, wherein the second frame mount includes an upwardly extending arm configured to engage a lower surface of the deck.

8. The patient support of claim 1, wherein the accessory mount includes a first mount plate, a second mount plate laterally spaced from the first mount plate, the first and second mount plates being configured to releasably clamp to the first frame member.

9. The patient support of claim 1, wherein the accessory mount is prevented from moving longitudinally in a first mode of operation and is longitudinally movable in a second mode of operation.

10. The patient support of claim 1 wherein the longitudinally extending support member includes a first position coupled the first frame member and a second position uncoupled from the first frame member.

11. The patient support of claim 10, wherein the medical accessory is adapted to couple to the articulating deck.

12. A patient support comprising:

a deck;

a mattress supported by the deck;

a first siderail positioned adjacent the deck and configured to extend above the mattress;

a second siderail positioned adjacent the first siderail and defining a longitudinally extending gap between the second siderail and the first siderail, the second siderail including a rail member, a linkage base, and a linkage coupling the rail member to the linkage base for movement of the rail member relative to the mattress between a raised position and a lowered position;

a longitudinally extending support member and an accessory mount coupled to the support member for selective sliding movement therealong, the second siderail being coupled to the accessory mount; and wherein the linkage base of the second siderail is supported for longitudinal movement relative to the first siderail for adjusting the longitudinal dimension of the gap.

13. The patient support of claim 12, wherein the second siderail is supported for lateral movement.

14. The patient support of claim 13, further comprising a pair of spaced-apart rods configured to permit lateral sliding movement of the siderail relative thereto.

15. The patient support of claim 14, wherein the accessory mount includes a first mount plate, a second mount plate laterally spaced from the first mount plate, the first and second mount plates being configured to releasably clamp to the first frame member.

16. A siderail assembly for a patient support, the siderail assembly comprising:

a rail member;

a support rail configured to detachably couple to a frame of a patient support;

a mount detachably coupled to the support rail and configured to selectively move along the support rail, the accessory mount including a lock configured to prevent movement of the mount along the support rail; and a linkage coupled between the rail member and the mount, the linkage supporting the rail member for movement between a raised position and a lowered position.

17. The siderail assembly of claim 16, wherein the mount includes first and second mount plates positioned on opposing sides of the support rail.

18. The siderail assembly of claim 17, wherein the lock includes at least one fastener which pulls the first and second mount plates toward each other thereby clamping the support rail therebetween.

19. The siderail assembly of claim 16, wherein the mount includes a pair of spaced-apart rods configured to permit lateral sliding movement of the linkage relative thereto.

20. The siderail assembly of claim 16, wherein the linkage comprises a linkage base coupled to the accessory mount, and a support arm pivotally coupling the rail member to the linkage base.

21. A method for altering a patient support including a deck support, an articulating deck, a first siderail coupled to the articulating deck, and a second siderail positioned in spaced relation to the first siderail, the method comprising the steps of:

uncoupling the first siderail from the articulating deck; and coupling the first siderail to the deck support.

22. The method of claim 21, further comprising the steps of:

providing a sub-frame; and coupling the sub-frame to the deck support, wherein the first siderail is coupled to the deck support through the sub-frame.

23. The method of claim 21, further comprising the step of adjusting the longitudinal position of the first siderail relative to the second siderail.

24. The method of claim 21, further comprising the step of adjusting the lateral position of the first siderail relative to the articulating deck.

25. A sub-frame for supporting at least one siderail of a patient support, the patient support including at least one siderail, an articulating deck and a deck support having at least one post, the sub-frame comprising:

a body member;

a first mount adapted to couple to the deck support;

a second mount adapted to couple to the deck, the body member extending between the first mount and the second mount, the second mount including a cylindrical mounting post extending upwardly from the body member and configured to be received within an aperture formed within the deck; and a rail mount is coupled to the body member and is adapted to support at least one siderail of the patient support.

26. The sub-frame of claim 25, wherein the rail mount includes a pair of spaced-apart rods configured to permit sliding of the siderail thereon.

27. The sub-frame of claim 25, wherein the first mount includes an aperture adapted to receive at least one of the posts of the deck support of the patient support therein.

28. The sub-frame of claim 25, wherein the first mount includes a bracket and at least one fastener configured to secure the bracket to the deck support.

29. The sub-frame of claim 25, wherein the rail mount includes a pair of spaced-apart rods configured to permit lateral sliding movement of the siderail relative thereto.

30. The sub-frame of claim 25, wherein:

the body member comprises an outer rail member and an inner rail member extending substantially parallel to the outer rail member; and the rail mount including a first mounting plate coupled to the inner rail member, and a second mounting plate coupled to the outer rail member.

31. The sub-frame of claim 25, wherein the first mount adapted to detachably couple to the deck support and the second mount is adapted to detachably couple to the deck.

* * * * *